US005263750A

United States Patent [19]

Smith et al.

[11] Patent Number: 5,263,750

[45] Date of Patent: Nov. 23, 1993

[54] SNAP-TOGETHER DOOR HANDLE AND HOUSING ASSEMBLY FOR A VEHICLE

[75] Inventors: Dennis E. Smith, Southfield; Joseph E. Mishark, Rochester Hills, both of Mich.

[73] Assignee: General Motors Corporation, Detroit, Mich.

[21] Appl. No.: 954,124

[22] Filed: Oct. 1, 1992

[51] Int. Cl.[5] ..... E05B 3/00

[52] U.S. Cl. ..... 292/336.3; 292/DIG. 31; 292/DIG. 38; 292/DIG. 53

[58] Field of Search ..... 292/336.3, 347, 113, 292/247, DIG. 31, DIG. 38, DIG. 53; 70/466

[56] References Cited

U.S. PATENT DOCUMENTS

| | | | |
|---|---|---|---|
| 3,047,321 | 7/1962 | Gander | 292/DIG. 31 X |
| 3,479,701 | 11/1969 | Zerfoss | 292/247 X |
| 4,580,822 | 4/1986 | Fukumoto | 292/DIG. 31 X |
| 4,834,433 | 5/1989 | Keller | 292/DIG. 31 X |
| 4,872,366 | 10/1989 | Appleby et al. | 292/DIG. 31 X |
| 4,882,919 | 11/1989 | Craig | 292/DIG. 31 X |
| 5,129,694 | 7/1992 | Tanimoto et al. | 292/DIG. 31 X |

*Primary Examiner*—Richard E. Moore

*Attorney, Agent, or Firm*—Charles E. Leahy

[57] ABSTRACT

A door handle assembly for attachment to a door panel includes a handle housing and a door handle. The handle and housing include self-locking snap-together pivot connection portions for connecting the handle pivotally to the housing. A torsion spring continuously biases the handle toward the housing.

3 Claims, 2 Drawing Sheets

SNAP-TOGETHER DOOR HANDLE AND HOUSING ASSEMBLY FOR A VEHICLE

TECHNICAL FIELD

The invention relates to a door handle assembly for a motor vehicle of the type having a door handle and a door handle housing and more particularly to the pivot connection between the handle and housing.

BACKGROUND OF THE INVENTION

It is well known in motor vehicles to construct a vehicle door including an apertured door panel and to attach a door handle assembly to the panel for remotely operating a latching mechanism of the door. The handle assembly typically is comprised of a housing attachable directly to the door panel and a handle pivotally attached to the housing for remotely operating the latching mechanism. A separate pivot pin is typically employed to attach the door handle pivotally to the housing as shown, for example, U.S. Pat. No. 5,183,302, issued Feb. 2, 1993 and assigned to the assignee of this invention.

The U.S. Pat. No. 4,580,822 to Fukumoto, granted Apr. 8, 1986 discloses a door handle assembly in which the handle and housing members have integral pivot connection portions and more particularly a ball and socket connection. This prior connection, however, requires the lever to be precisely aligned with the housing in order for the ball portion of the connection to be inserted in the socket portion, thus making assembly difficult. Furthermore, an independent retaining clip is needed in order to limit the range of movement of the door handle to keep the ball and socket sections connected during pivoting of the lever.

In view of the above, it is desirable to provide a pivot connection between the door handle and housing without necessity for multiple components such as independent coupling devices exemplified by the pivot pins and retaining rings above.

SUMMARY OF THE INVENTION AND ADVANTAGES

A door handle assembly for disposition in a door panel of a vehicle door for remotely operating a latching mechanism of the door comprises housing means for attachment to the door panel, a door handle, and integral self-locking snap-together pivot connection means for automatically locking the handle into snap-together retaining engagement with the housing means and establishing a pivot connection therebetween in response to applying an assembly force to the handle and housing means.

The invention also contemplates a door handle assembly comprising a handle housing having front and back sides and an opening therethrough. The housing includes integral mounting legs projecting from the back side of the housing for lockingly engaging the panel. A door handle is disposed in the opening of the housing and has an actuating portion extending beyond the front side of the housing for grasping by a user of the assembly and a lever arm portion extending beyond the back side of the housing for attachment to a latch control rod for remotely operating the locking mechanism of the door. The housing has a pair of integral flexible support arms projecting from the back side of the housing on opposing sides of the opening and including a pair of aligned apertures extending through the support arms. The door handle has a corresponding pair of pivot posts projecting from opposite sides of the handle and journaled in the apertures for pivotally connecting the lever to the housing. The support arms include guide slots extending radially toward the apertures for guiding the posts slidably into engagement with the apertures. The guide slots have cooperating camming bottom walls which are narrowingly tapering toward the apertures for bearing against the posts as the posts are slid along the guide slots toward the apertures and causing the flexible support arms to deflect away from one another until such time as the posts are received in the apertures after which time the support arms return to their nondeflectic condition for capturing the pivot posts in the apertures. A spring reacts between the handle and the housing for continuously biasing the handle toward the housing.

An advantage of the invention is that the handle may be pivotally connected to the housing without requiring additional independent parts, such as pivot pins or retaining clips. The integral snap-together portions of the handle and housing simplifies the construction of door handle assemblies and lessens the time and effort required to join the handle to the housing.

BRIEF DESCRIPTION OF THE DRAWINGS

These and other objects, features, and advantages of the invention will become apparent upon consideration of the description of the preferred embodiment and the appended drawings, in which.

DESCRIPTION OF THE PREFERRED EMBODIMENT

Figure 1:
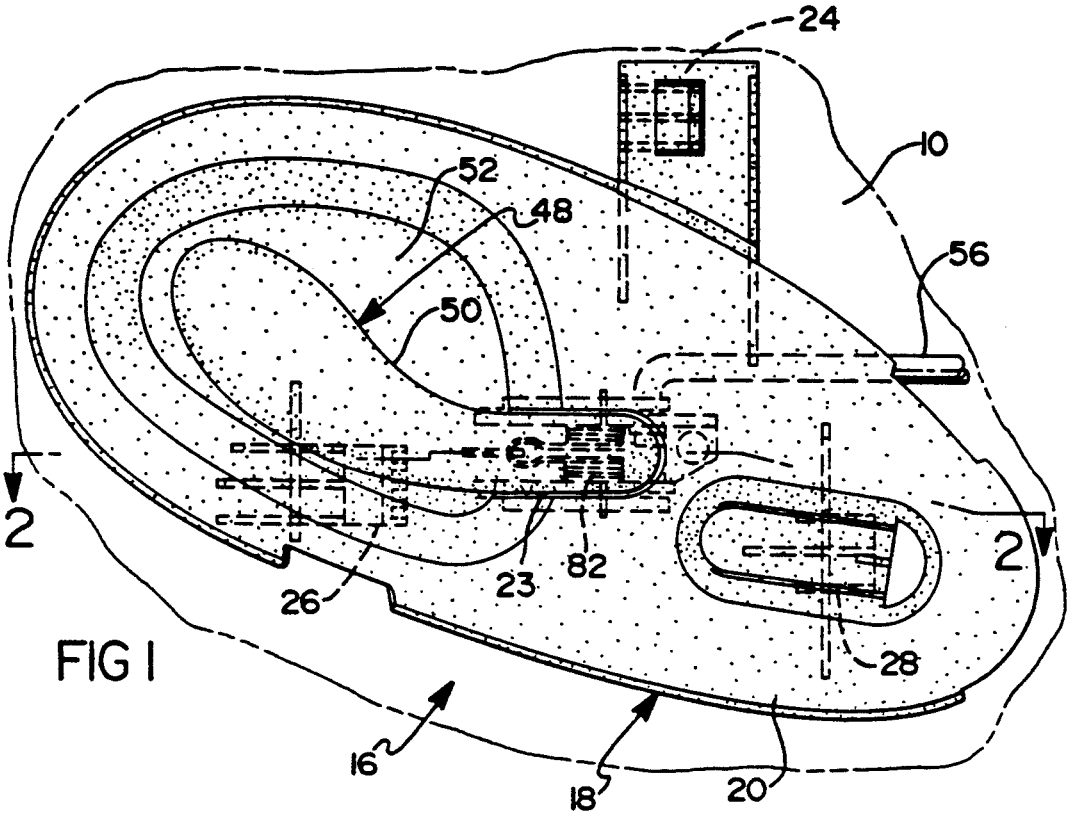
FIG. 1 is a front view of the door handle assembly.
Figure 2:
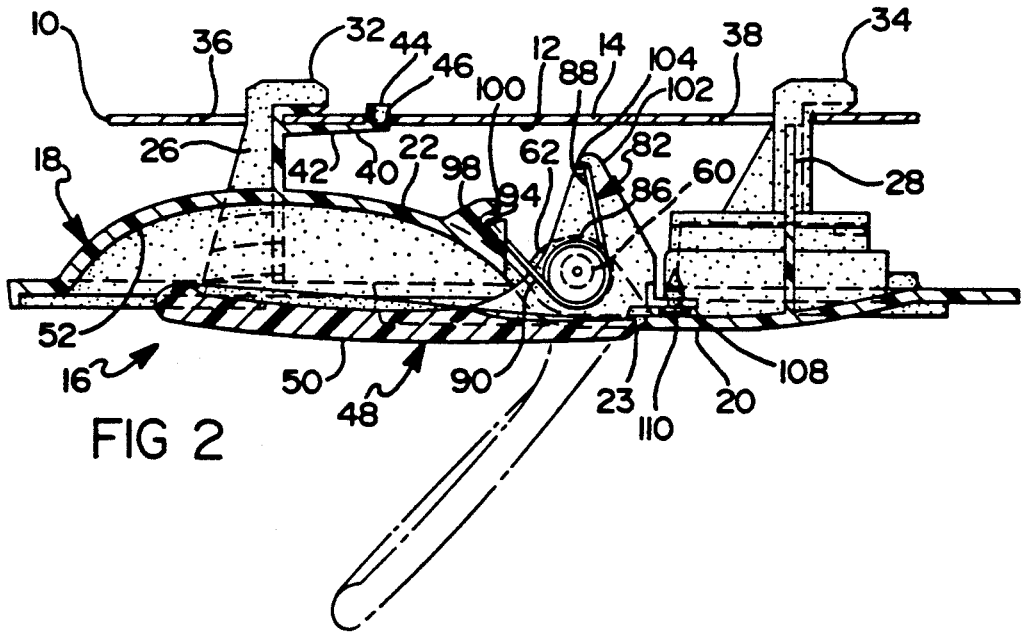
FIG. 2 is a cross-sectional view taken along lines 2—2 of FIG. 1.

FIG. 1 shows a portion of a vehicle door panel 10 which is conventionally stamped from sheet metal. As seen in FIG. 2 the panel 10 has a surface 12 and an underside 14.

As best seen in FIGS. 1 and 2, a door handle assembly 16 is provided for disposal in the door panel 10 for remotely operating a latching mechanism (not shown) of the door. The door handle assembly 16 includes housing means in the form of a molded plastic handle housing 18 for attachment to the door panel 10. The housing 18 has a front side 20, a back side 22 and an opening 24 extending through the housing 18 between the front and back sides 20, 22. The housing 18 is attached to the door panel 10 by a plurality of mounting legs 24, 26, and 28 projecting from the back side 22 of the housing 18. Each of the mounting legs includes an anchor foot 30, 32, and 34, respectively, which extends into underlying engagement with the under side 14 of the panel 10 when the mounting legs are lowered through corresponding apertures in the panel 10 and then slid in a rightward direction as viewed in FIG. 2. FIG. 2 shows only the apertures 36, 38 through which the mounting legs 26 and 28 are extended, but it will be appreciated that a similar aperture (not shown) is provided for the mounting leg 24. The anchor feet 30, 32, 34 function to anchor the housing 18 to the panel 10 in a manner which will prevent the housing 18 from being pulled away from panel 10.

The mounting leg 26 further includes a locking arm 40 having a shank portion 42 extending parallel to the anchor foot 32 but spaced therefrom a distance corresponding approximately to the thickness of the panel 10. The panel 10 is captured between the shank 42 and anchor foot 32 as shown in FIG. 2. The locking arm 40 also includes an enlarged head 44 formed at the end of the shank 42 and extending toward the anchor foot 32. When installing the housing 18 in the door panel 10, the head 40 engages the surface 12 of the panel 10 and rides along the surface 12 causing the shank 42 to deflect away from the anchor foot 32. The panel 10 includes a locking aperture 46 formed to the right of aperture 36, as viewed in FIG. 2, in a position such that when the housing 18 has been fully slid to the right, the shank 42 will return to its undeflected condition as the head 44 drops into the locking aperture 46, thereby locking the housing 18 against removal. In this manner, the housing 18 is prevented from sliding in the leftward direction which would permit the feet of the mounting legs 24, 26, and 28 from becoming disengaged from the underside 14 of the panel 10.

A molded plastic door handle 48 is disposed in the opening 23 of the housing 18 and has an actuating portion 50 thereof extending beyond the front side 20 of the housing 18 above a recess or well 52 of the housing for grasping by a user of the assembly. The handle 48 also includes a lever arm portion 54 extending beyond the back side 22 of the housing 18 for attachment to a latch control rod 56 for remotely operating the latching mechanism (not shown) of the door. The connection between the lever arm 54 and the rod 56 is preferably provided by a hole in the lever arm 54 through which a bent end portion of the rod 56 is extended and retained against disengagement by a spring clip 58.

The housing 18 and handle 48 include integral self-locking snap-together pivot connection means 60 for automatically locking the handle 48 into snap-together retaining engagement with the housing 18 and establishing a pivot connection therebetween in response to applying an assembly force to the handle 48 and housing 18.

Figure 3:
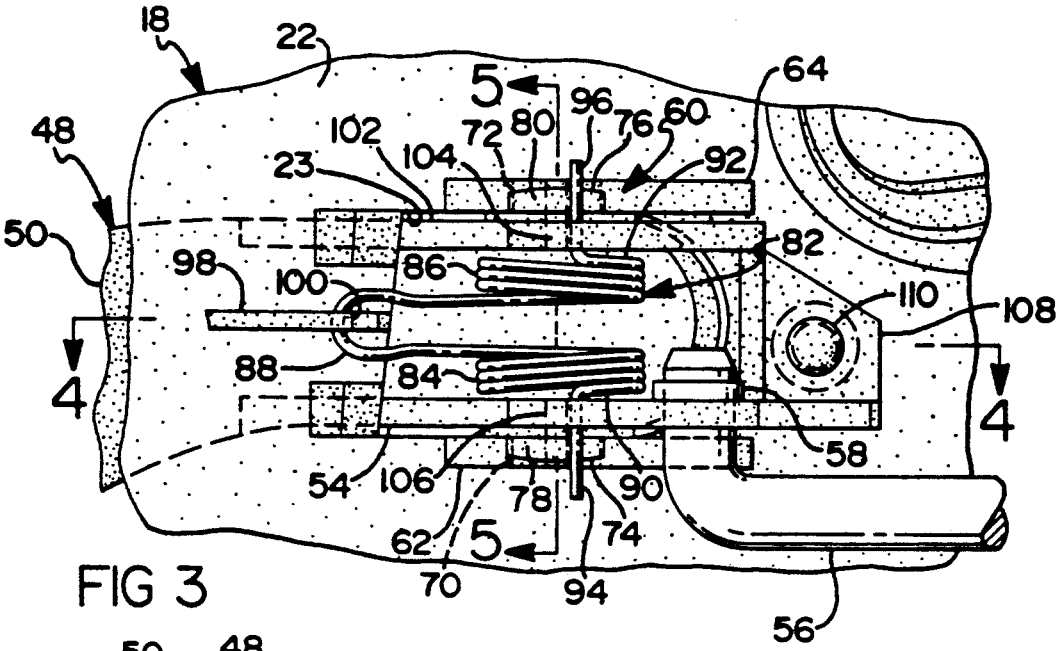
FIG. 3 is an enlarged fragmentary rear view of the door handle assembly.
Figure 5:
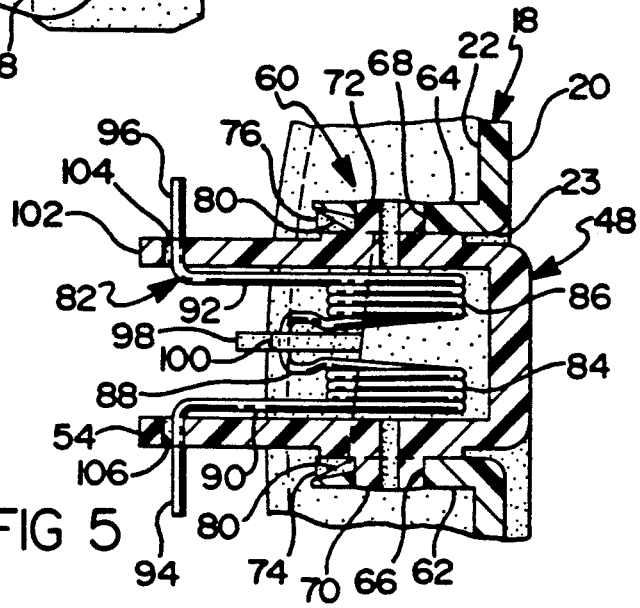
FIG. 5 is an enlarged fragmentary cross-sectional view taken along lines 5—5 of FIG. 3.

The pivot connection means 60 comprises a pair of flexible support arms 62, 64 integral with the housing 18 and projecting from the back side 22 thereof on opposite sides of the opening 23, as best seen in FIGS. 3 and 5. The support arms 62, 64 are formed with a pair of aligned apertures 66, 68 having continuous annular walls. The pivot connection means also comprises a corresponding pair of annular pivot studs or posts 70, 72 integral with the handle 48 and projecting from opposite sides thereof through the apertures 66 and 68, respectively, such that the posts are journaled by the aperture walls enabling the handle 48 to pivot relative to the housing between an unactuated position, shown by solid lines in FIG. 2, and an actuating position, shown as broken lines in FIG. 2, in which the handle is pivoted outwardly of the housing.

The support arms 62, 64 and posts 70, 72 are self-locking such that the handle 48 remains connected to the housing 18 through its full pivotal motion without the necessity for additional independent component parts. This self-locking feature is attributable to the flexibility of the support arms 62, 64. As shown most clearly in FIG. 5, the spacing between the support arms 62, 64 is closer than the spacing between the ends of the pivot posts 70 and 72. However, since the support arms 62, 64 are flexible, the pivot posts 70, 72 are able to be inserted into the apertures 66, 68 by forcing the pivot posts 70, 72 between the support arms 62, 64, causing them to flex outwardly of one another, and then sliding the posts 70, 72 into engagement with the apertures 66, 68, after which time the support arms 62, 64 deflect back to their undeflected condition so as to retain the posts 70, 72 securely within the apertures 66, 68. Since the walls of the apertures 66, 68 are preferably continuous, there is no means for the pivot posts 70, 72 to escape from the apertures 66, 68 during pivoting of the handle 48.

To assist in the snap-together connection of the handle 48 and housing 18, the support arms 62, 64 are provided with guide slots 74, 76 which extend from the periphery of the support arms 62, 64 radially toward the apertures 66, 68 for slidably guiding the posts 70, 72 between the support arms 66, 64 and into engagement with the apertures 66, 68. Additionally, the guide slots 74, 76 are provided with cooperating camming bottom walls 78, 80 which are narrowingly tapered or ramped toward the apertures 66, 68 for bearing against the posts 70, 72 as they are guided along the slots 74, 76 toward the apertures 66, 68. The camming bottom walls 78, 80 thus assist in the snap-together assembly of the handle 48 and housing 18 through camming action 15 with the pivot posts 70, 72 as the posts are bodily forced along the guide slots 74, 76 toward engagement with the apertures 66, 68.

The assembly includes spring biasing means in the preferred form of the torsion spring 82 interacting between the handle 48 and the housing 18 for continuously biasing the handle 48 toward the housing 18 (i.e., toward the unactuated position as shown in FIG. 2). The torsion spring 82 includes a pair of symmetrical portions 84, 86 joined by a central U-shaped portion 88. The coil spring 82 includes a pair of L-shaped end portions 90, 92 extending from each of the coiled portions 84, 86 and each including an outwardly bent foot 94, 96 projecting transversely and outwardly of the coiled portions 84, 86, as best seen in FIGS. 3 and 5.

Figure 4:
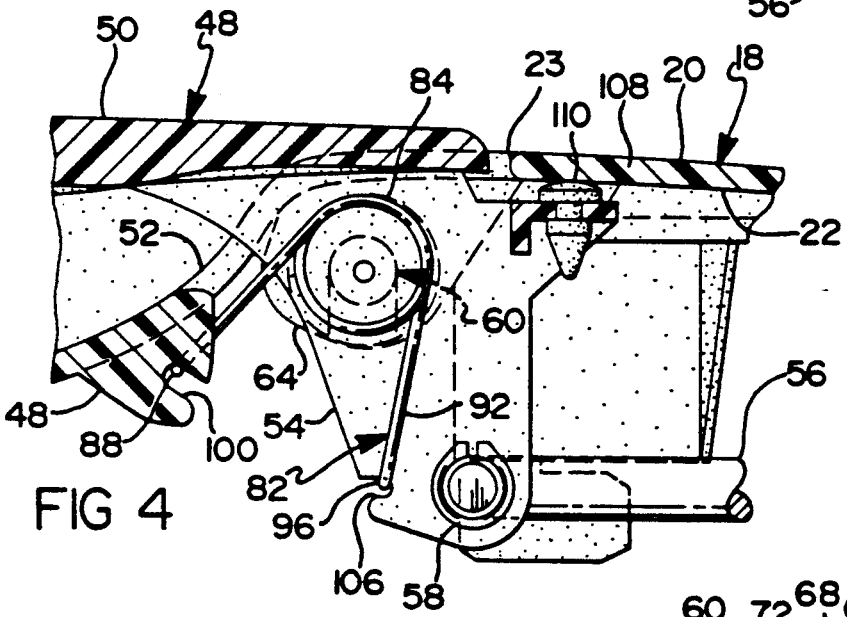
FIG. 4 is an enlarged fragmentary cross-sectional view taken along lines 4—4 of FIG. 3.

The housing 18 includes a fin-like spring retaining projection 98 extending outwardly from the back side 22 of the housing 18 and formed with a spring-engaging recess in the preferred form of a slot or groove 100 as been seen in FIGS. 2 and 4. The handle 48 includes a similar, but larger, fin-like spring attachment projection 102 formed integrally with the handle 48 and extending outwardly of the back side 22 of the housing 18 in parallel spaced relationship to the lever arm portion 54 of the handle 48. Both the projection 102 and the lever arm portion 54 are likewise each formed with a spring-engaging recess in the preferred form of a slot or a groove 104, 106.

The spring 82 is attached to the handle 48 and housing 18 with the coiled portions 84 disposed between the handle projection 102 and the lever arm portion 54 and concealed from frontal view by the actuating portion 50 of the handle. The U-shaped central portion 88 is disposed within the groove 100 of the housing projection 98 and the outwardly projecting feet 92, 94 of the L-shaped portions 90, 92 are disposed in each of the grooves 104, 106 of the handle projection 102 and lever arm portion 54 of the handle 48. The handle 48 includes a stopping portion 108 fitted with a resilient soft rubber bumper 100 which engages the back side 22 of the housing 18 and limits the inward pivotal movement of the handle 48 beyond the unactuated position. The spring 82 continuously urges the stopping portion 108 against the housing 18 so as to normally bias and maintain the handle 48 in the unactuated position.

To assemble the handle 48 and housing 18, the actuating portion 50 of the handle 48 is inserted into the opening 23 of the housing 18 through the back side 22 thereof and the posts 70, 72 of the handle 48 positioned in the guide slots 74, 76 of the housing 18. A pulling force is applied to the handle 48 causing the posts 70, 72 to be forcibly guided along the slots 74, 76 and the support arms 62, 64 to be deflected outwardly from one another to enable the posts 70, 72 to enter the apertures 66, 68. Once the posts 70, 72 are received into the apertures 66, 68, the support arms 62, 64 flex back to the undeflected condition for retaining the posts 70, 72 within the apertures 66, 68. In this manner, there is a self-locking snap-together pivot connection established between the handle 48 and housing 18.

Once the handle 48 is connected to the housing 18, the spring 82 is installed by inserting the coiled portions 84, 86 between the actuating portion 50 and projection 102 of the handle and disposing the U-shaped portion 88 of the spring 82 within the groove 100 of the housing projection 98. The leg portions 90, 92 are connected by forcing the feet 94, 96 into the grooves 104, 106 of the handle 48 where they are retained in place. The door handle assembly 16 may then be attached to the door panel 10 in the manner described above.

The invention has been described in an illustrative manner and it is to be understood that the terminology which has been used is intended to be in the nature of words of description rather than of limitation. Many modifications and variations of the present invention are possible in light of the above teachings. It is, therefore, to be understood that the invention may be practiced otherwise than as specifically described.

We claim:

1. A door handle assembly for disposition in a door panel of a vehicle door for remotely operating a latching mechanism of the door, said assembly comprising:

housing means for attachment to the door panel;

a door handle;

said housing means and said handle including integral self-locking snap-together pivot connection means for automatically locking said handle into snap-together retaining engagement with said housing means and establishing a pivot connection therebetween in response to applying an assembly force to said handle and said housing means, and having mutually engagable male and female portions of said housing means and said handle, with one of said portions being flexible, and biasing means includes a torsion spring having a pair of symmetrical coiled portions and a central U-shaped portion interconnecting said coil portions, said spring having an L-shaped leg portion extending from each of said coil portions, said U-shaped portion acting against said back side of said housing and said leg portions acting against said handle for biasing said handle pivotally toward said housing means.

2. The assembly of claim 1 wherein said housing includes an integral spring retaining projection on said backside thereof and including a groove, said handle having a pair grooves, said U-shaped portion of said spring disposed in said groove of said housing projection and said leg portions of said spring disposed in said grooves of said handle.

3. A door handle assembly for disposition in a door panel of a vehicle for remotely operating a latching mechanism of the door, said assembly comprising:

a handle housing having front and back sides and an opening therethrough, said housing including integral mounting legs projecting from said back side for lockingly engaging the panel;

a door handle disposed in said opening having an actuating portion thereof extending beyond said front side of said housing for grasping by a user of said assembly and a lever arm portion extending beyond said backside of said housing for attachment to a latch control rod for remotely operating the latching mechanism of the door;

said housing having a pair of integral flexible support arms projecting from said backside on opposing sides of said opening and including a pair of aligned apertures extending through said support arms, said door handle having a corresponding pair of pivot posts projecting from opposite sides of said handle and journaled in said apertures for pivotally connecting said lever to said housing, said support arms including guide slots extending radially toward said apertures for guiding said posts slidably into engagement with said apertures, said guide slots having cooperating camming bottom walls which are narrowingly tapered toward said apertures for bearing against said posts as said posts are slid along said guide slots toward said apertures and causing said flexible support arms to deflect away from one another until such time as said posts are received in said apertures after which said support arms return to their nondeflected condition for capturing said pivot posts in said apertures; and a spring reacting between said handle and said housing for continuously biasing said handle toward said housing.

* * * * *